US005630984A

United States Patent [19]

Waschke et al.

[11] Patent Number: 5,630,984

[45] Date of Patent: May 20, 1997

[54] BRASS ALLOY

[75] Inventors: Helmut Waschke, Stein; Leopold Sauer, Wittlich, both of Germany

[73] Assignee: Ideal-Standard GmbH, Bonn, Germany

[21] Appl. No.: 614,726

[22] Filed: Mar. 13, 1996

Related U.S. Application Data

[63] Continuation of Ser. No. 347,295, Dec. 1, 1994, abandoned.

[30] Foreign Application Priority Data

| | | | |
|---|---|---|---|
| Jun. 2, 1992 | [DE] | Germany | 42 18 513.0 |
| Dec. 4, 1992 | [DE] | Germany | 42 40 880.6 |
| Apr. 16, 1993 | [DE] | Germany | 43 12 484.4 |
| Apr. 16, 1993 | [DE] | Germany | 43 12 466.6 |

[51] Int. Cl.[6] ..... C22C 9/01

[52] U.S. Cl. ..... 420/478; 148/434; 29/890.12

[58] Field of Search ..... 148/434; 420/478; 29/890.12

[56] References Cited

U.S. PATENT DOCUMENTS

| | | | |
|---|---|---|---|
| 5,137,685 | 8/1992 | McDevitt et al. | 420/477 |
| 5,288,458 | 2/1994 | McDevitt et al. | 420/477 |
| 5,360,591 | 11/1994 | Ruetz et al. | 148/434 |

FOREIGN PATENT DOCUMENTS

| | | | |
|---|---|---|---|
| 889984 | 9/1953 | Germany . | |
| 3834460 | 4/1989 | Germany . | |
| 54-135618 | 10/1979 | Japan . | |
| 56-166352 | 12/1981 | Japan | 420/478 |
| 61-133351 | 6/1986 | Japan . | |
| 2211206 | 6/1989 | United Kingdom . | |

OTHER PUBLICATIONS

Nishikiori et al., "Free–cutting copper alloys etc.", JP 61,133,351, Jun. 20, 1986, *Chemical Abstracts*, vol. 106, p. 270, 1987, Abstract.

*Primary Examiner*—John Sheehan
*Attorney, Agent, or Firm*—Spencer & Frank

[57] ABSTRACT

A brass alloy having a composition (wt %) as follows: Cu: 57–65%; Bi: 0.3–1.5%; Al: 0.4–0.8%; B: 5–15 ppm; impurities 0–1%, and Zn as remainder. A brass alloy whose Cu content is set to 57–65 wt % and whose further alloying constituents do not exceed 3 wt % can be cast into a chill mold without any problems and, additionally, solidifies from the melt relatively finely grained and thus virtually free of shrinkholes. Further, grain refining with boron is possible in spite of a Cu content that is increased compared to the known alloys, if the elements Mn, Si and Sb are added by alloying in amounts according to the invention and if, simultaneously, the Fe content can be limited to a maximum of 0.25 wt %. Furthermore, the alloy is provided with enhanced hot shortness if the Sn content is as low as possible but, at least, does not exceed 0.25 wt %. The occurrence of hard inclusions is strongly repressed.

9 Claims, No Drawings

BRASS ALLOY

CROSS-REFERENCE TO RELATED APPLICATIONS

This is a continuation of application Ser. No. 08/347,295 filed Dec. 1, 1994, now abandoned.

BACKGROUND OF THE INVENTION

1. Field of the Invention

The invention relates to an alloy based on copper with zinc as an alloying constituent having the next to the highest share in the alloy.

2. Description of the Related Art

Such alloys, generally called brass, are used for the production of very different technical devices and components. Depending on the application, different alloying constituents are added to the brass alloys in order to obtain very specific properties which correspond to the respective intended use. If, for example, alloys are to be provided that are suitable for machining, the element lead is usually added to them in amounts of approximately 1 to 3 wt %. The lead has the effect that the chips occurring during machining are short-brittle. This characteristic is indispensable, particularly for the machining of workpieces on automatic machines.

When such lead-containing alloys are used for the production of components for the drinking water supply, there is the risk that the alloying constituent lead passes into the drinking water. Together with the drinking water, the lead reaches the human organism via the gastrointestinal tract, is mainly accumulated in the bones and leads to the known damage. Hazards due to lead are, however, also present in companies that produce lead-containing brass by melting or process products made from it. Here, the lead may enter the body through ingestion, inhalation or skin resorption.

It is known from DE 38 34 460 C2 to use an alloy for the production of components for water supply installations containing 1.5 to 7 wt % bismuth, 5 to 15 wt % zinc, 1 to 12 wt % tin and copper as remainder with accidental impurities. This is a red cast alloy which means a tin bronze with zinc as an additional alloying constituent. The disadvantage of such alloys is that they have a very wide solidification range because of the formation of a mixed substitution crystal between copper and zinc. This is a considerable disadvantage in that these alloys are only marginally suited for chill casting. This is mainly due to the fact that they have a relatively high melting temperature. The result of this is that, already after a few casting cycles, the chill molds become unusable owing to the high thermal stress. Furthermore, these alloys have a comparatively wide solidification range of approximately 150° C. Together with the relatively high cooling rates in chill casting, this leads to an increased hot shortness of the cast parts. Therefore, the alloys mentioned above can virtually only be used for sand casting processes.

A further disadvantage of the known alloy is the fact that a relatively high bismuth portion is required to make machining possible.

On this basis, it is the object of the invention to provide an alloy that is low in lead content or that is lead-free and suitable for the production of components for drinking water installations, which does not have the above disadvantages. The alloy should continue to have the casting and mechanical properties necessary for the intended use. Water fittings, for example, should have a polishable surface and a pressure-tightness that is sufficient for the pressure ranges prevailing in drinking water supply systems, properties that depend directly on the fine-grainedness of the structure of the cast parts.

SUMMARY OF THE INVENTION

This object is solved by the present invention which provides an alloy containing 57 to 65 wt % copper, up to 3 wt % other alloy constituents and melt-related impurities, an additive making machining possible, and zinc as remainder, characterized in that the additive is bismuth. Surprisingly, it turned out that an alloy whose Cu content is set to 57–65 wt % and whose further alloying constituents do not exceed 3 wt % can be cast into the chill mold without any problems and, additionally, solidifies from the melt relatively finely grained and thus virtually free of shrinkholes. The latter is particularly advantageous in cases where the alloy is used to cast molded parts that should have a smooth and polishable surface, as is the case with high-quality fittings for kitchen and plumbing uses. Furthermore, the fittings made with the alloy according to the invention are provided with a very good pressure-tightness which is due to the absence of shrinkholes or "sponge-like" regions in inner walls or sealing surfaces that separate different pressure zones. Sponge-like regions are understood to mean structural regions having a broken up, cavity-containing structure similar to a sponge. A further advantage of the invention is the fact that it is provided with good flow properties which is particularly important for the production of molded parts with a complex design.

If lead, which has been used so far as an alloying constituent, is replaced by bismuth, the components produced with the alloy according to the invention can practically be classified as toxicologically safe. A cumulative toxic effect corresponding to that of lead is not known for bismuth. According to the DAB (Deutsches Arzneibuch, German Dispensatory), bismuth is considerably less toxic than lead so that, in comparison, the concentrations caused by the passage of bismuth into the drinking water should lead to only a very minor potential health hazard. As could be shown with microorganisms and small animals, the toxic effect of bismuth on these organisms is approximately 10 times smaller than that of lead. Another indicator for the relative non-toxicity of bismuth can be seen in the fact that bismuth was classified as not hazardous to health in the German Regulation on Hazardous Materials and, contrary to lead, bismuth is not mentioned in standard regulations such as the TVO (Trinkwasserverordnung, Drinking Water Regulation).

During the production of the alloy according to the invention, minor lead contaminations may possibly occur depending on the degree of purity of the alloying constituents used. Normally, however, these only amount to levels of approximately 0.3 wt % at most and are therefore rather negligible compared to the lead additives deliberately added to lead-containing brass alloys.

Advantageous compositions of an alloy according to the invention follow. The alloy may have the following composition (wt %): Cu: 57–62%; Bi: 0.3–1.5%; Al: 0.4–0.8%; B: 5–15 ppm; impurities: 0–1%; and Zn: remainder. Further, the alloy may have the following composition (wt %): Cu: 59.78; Al: 0.60; Bi: 1.00; B:13 ppm; Pb: 0.02; Sn: 0.01; Fe: 0.02; Sb: 0.01; Si: 0.01; and Zn: remainder. Here, it should be emphasized in particular that an addition of boron in an amount of 5 to 15 ppm can reduce the mean grain size of the structure.

The invention additionally includes an alloy having a composition as follows (wt %): Cu: 62–65%; Bi: 0.3–1.5%; Mn: 0.3–0.7%; Si: 0.3–0.7%; Al: 0.3–0.7%; Sb: 0.05–0.15%; B: 5–15 ppm; miscellaneous:<1%; and Zn: remainder. The alloy may have a composition as follows (wt %): Cu: 62–65%; Bi: 0.5–1.5%; Mn: 0.3–0.5%; Si: 0.5–0.7%; Al: 0.3–0.7%; Sb: 0.05–0.1%; B: 5–15 ppm; Pb: 0–0.3%; Sn: 0–0.25%; Fe: 0–0.208; Ni: 0–0.5%; and Zn: remainder. The advantage of these alloys is that they are dezincification-resistant. Because of this characteristic, drinking water fittings, for example, made from these alloys can also be used in areas with high water aggressivity and they have a generally higher service life.

In order to arrive at dezincification-resistant brass alloys when starting from conventional brass alloys, such as Ms 60 Fk, it is necessary to increase the Cu content, for example, to 64%. Such alloys, however, are not suitable for many applications, specifically for the manufacture of fittings for sanitary installations, because their structure is too coarse, which brings about the known negative concomitant phenomena such as increased formation of shrinkholes. Up until now, efforts have failed to refine the grain of brass alloys having an increased Cu content by means of boron which is normally used for these purposes. Therefore, virtually only the known, not dezincification-resistant alloys were used for the application mentioned.

It turned out, surprisingly, that grain refining with boron is possible in spite of a Cu content that is increased compared to the known alloys, if the elements Mn, Si and Sb are added by alloying in amounts according to the invention and if, simultaneously, the Fe content can be limited to a maximum of 0.25 wt %. Furthermore, it turned out, surprisingly, that the alloy is provided with enhanced hot shortness if the Sn content is as low as possible but, at least, does not exceed 0.25 wt %. A further advantage is that the occurrence of hard inclusions is strongly repressed. Hard inclusions, which are mainly disturbing during surface finishing, mainly occur in increased numbers in conventional lead-containing brass alloys if these have been refined with boron.

The invention additionally includes an alloy characterized in that the composition is as follows (wt %): Cu: 63.0%; Bi: 0.8%; Mn: 0.45%; Si: 0.5%; Al: 0.5%; Sb: 0.1%; B: 10 ppm; Pb: <0.1%; Sn: <0.1%; Fe: <0.1%; Ni: <0.1%; Zn: remainder. The invention further includes an alloy characterized in that the composition is as follows (wt %): Cu: 64.81%; Bi: 0.33%; Mn: 0.44%; Fe: 0.039%; B: 15 ppm; Ni: <0.01%; Si: 0.53%; Sn: <0.01%; Pb: <0.01%; Al: 0.53%; Zn: remainder. The invention additionally includes an alloy characterized in that the composition is as follows (wt %): Cu: 64.83%; Bi: 0.53%; Fe: 0.049%; Mn: 0.40%; B: 15 ppm; Ni: <0.01%; Si: 0.53%; Sn: <0.01%; Pb: <0.01%; Al: 0.53%; Zn: remainder.

The invention also includes use of such alloys for the production of components for drinking water installations.

DESCRIPTION OF THE PREFERRED EMBODIMENTS

In the following, the invention is explained in greater detail by way of embodiments:

EXAMPLE 1

By melting together the corresponding alloying constituents, a melt was obtained containing 59.78 wt % Cu, 0.60 wt % Al, 1.00 wt % Bi, 13 ppm B, as melting-related contaminations 0.02 wt % Pb, 0.01 wt % Sn, 0.02 wt % Fe, 0.01 wt % Sb and Zn as remainder. The melt was cast to form sample ingots and finished cast parts (fittings). Different standard tests were carried out with parts of the ingots or with the finished parts:

In order to test the polishability of the alloy according to the invention a number of polishing tests were carried out. The result of this test series was that the formed parts produced with the alloy according to the invention are provided with the surface polishability required for high-quality fittings. Fracture tests were also conducted with all sample pieces. Here, it was found that there were practically no foreign inclusions or "sponge regions." Particularly the latter are often the reason for leakage if they are disposed in the separation walls between spaces with different pressurization or, for instance, in seats for seals.

The structure of the examined samples was essentially globutitic throughout and had a mean grain size of approximately 30 μm. The casting spiral flow length (according to Schneider) at a temperature of 1,000° C. to 1,005° C. was designated as the measure for the flowability of the alloy. The determined values were between 522 mm and 531 mm and thus within the range of the values known from Gk Ms 60 Fk (500 mm–600 mm).

Several finished parts were subjected to machining on automatic machines by producing threads and sealing end faces, as is done in the normal production process. It turned out that the molded parts cast with the alloy according to the invention could be machined just as well as those made from the conventional brass alloy Gk Ms 60 Fk. The chips that were machined off of the molded parts were short-brittle, as is the case with lead-containing brass alloys.

Also in grinding tests in which the material removal during a predetermined time was determined, no significant differences compared to conventional brass were found. With regard to the electroplating ability of the castings made from the alloy according to the invention there were also no differences found compared to conventional brass castings.

The mechanical properties were determined pursuant to DIN 1709, paragraph 5. From the wedge test specimens cast in conformity with standards, the lowest section was taken for the "round test specimen." The round test specimens were produced and drawn according to DIN 50150. The values that were determined are listed in the following table:

TABLE 1

| | Alloy acc. to invention | Gk Ms6O Fk |
|---|---|---|
| Elongation limit Rp 0.2 (N/mm$^2$) | 157.0 | 153.7 |
| Tensile strength Rm (N/mm$^2$) | 360.8 | 396 |
| Elongation at rupture A10 (%) | 12.6 | 19.7 |
| Brinell hardness 2.5/62.5 (HB) | 121 | 107 |

For the determination of the dezincification resistance, a dezincification sample was produced pursuant to the ISO Standard 6509-1981 (E). The dezincification test itself was carried out according to the Australian Standard No. 2345-1980. The dezincification depths found were greater than 100 μm throughout but were within the ranges known from Gk Ms 60 Fk.

EXAMPLE 2

This embodiment concerns an alloy of the following composition (wt %):

Cu: 63.00%, Bi: 0.8%, Mn: 0.45%, Si: 0.5%, Al: 0.5%, Sb: 0.1%, B: 10 ppm, Pb: <0.10%, Sn: <0.10%, Fe: <0.10%, Ni: <0.10%, Zn: remainder.

For the determination of the dezincification resistance, transverse sections were cold-separated from the plumbing fittings made from the alloy according to the invention (sample P III in Table 2) and subjected to a test pursuant to ISO 6509 (Corrosion of metals and alloys/Determination of dezincification resistance of brass-, edition 1981). The casting temperature was 1,000° C. For purposes of comparison, 2 samples (PI and PII) with the following known composition were tested (data in wt %):

Cu: 60.06%, Zn: 37.38%, Ni: 0.030%, Al: 0.65%, Mn: <0.010%, Sn: 0.10%, Sb: 0.020%, Si: 0.010%, Fe: 0.080%, Pb: 1.65%, B: 0.0008%.

The result of the dezincification resistance test is shown in the following Table 2:

TABLE 2

| Sample | Dezincification depth (μm) |
|---|---|
| P I | 550 |
| P II | 220 |
| P III | 60 |

In sample III, a dezincification depth of 60 μm was found, while the samples consisting of conventional Gk Ms 60 Fk had considerably greater dezincification depths. According to the standards BS 2872 (BS =British Standard), BS 2974, SS 11710 (SS=Swedish Standard) or the Swedish Construction Standard RS, the sample PIII is dezincification-resistant. The allowable dezincification depth for castings is 100 μm according to BS, 200 μm according to the Swedish Construction Standard R8.

The tests described in the following were carried out with samples PIV and PV having the following compositions (data in wt %):

PIV: Cu: 64.81%, Bi: 0.33%, Mn: 0.44%, Fe: 0.039%, B: 0.0015%, Ni: <0.01%, Si: 0.53%, Sn: <0.01%, Pb: <0.01%, Al: 0.53%, Zn: remainder.

PV: Cu: 64.83%, Bi: 0.53%, Fe: 0.049%, Mn: 0.40%. The remaining alloying constituents correspond to those of PIV.

First, the castings were cast under the usual production conditions. These castings were first subjected to a cylindrical machine grinding, a manual finish grinding and fine grinding and, finally, to a machine as well as manual polishing. In this process, the parts were channeled into the normal production and they were weighed in the raw state and after each of the mentioned operations. Here, it was found that, compared to castings made from conventional brass Gk Ms 60 Fk, the material removed through the machine grinding was significantly less. The surface quality of the parts made from the alloy according to the invention was better compared to that of conventional castings, which could be seen from a lower number of complaints after the first grinding or polishing operation. The above-mentioned samples PIV and PV were also subjected to fracture tests in order to examine their structure for shrinkholes and "sponge regions." All samples were free of such structural flaws.

The microstructure of the alloy corresponding to PIV and PV was determined with usual metallographic methods. The structure showed an essentially globulitic grain structure with a mean grain size of approximately 35 μm. The maximum grain size was below 100 μm.

For the determination of machinability, 60 castings (fittings) were machined on automatic machines. Sealing end faces and threads, for example, were produced. It was found that the machinability can take place without a considerable change of the machining parameters that are normal for conventional castings.

The mechanical parameters elongation limit, tensile strength, elongation at rupture and Brinell hardness were determined according to the usual standardized methods. The result of these series of tests was that the cited mechanical values were comparable to those of the known brass alloy Gk Ms 60 Fk.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. An alloy having a composition (wt %) as follows:

Cu: 57–65%

Bi: 0.3–1.5%

Al: 0.4–0.8%

B: 5–15 ppm impurities 0–1% and

Zn as remainder.

2. The alloy according to claim 1, wherein the composition (wt %) is as follows:

Cu: 57–62%

Bi: 0.3–1.5%

Al: 0.4–0.8%

B: 5–15 ppm impurities: 0–1% and

Zn: remainder.

3. The alloy according to claim 2, wherein the composition (wt %) is as follows:

Cu: 59.78

Al: 0.60

Bi: 1.00

B: 13 ppm

Pb: 0.02

Sn: 0.01

Fe: 0.02

Sb: 0.01

Si: 0.01 and

Zn: remainder.

4. An alloy having a composition (wt %) as follows:

Cu: 62–65%

Bi: 0.3–1.5%

Mn: 0.3–0.7%

Si: 0.3–0.7%

Al: 0.3–0.7%

Sb: 0.05–0.15%

B: 5–15 ppm miscellaneous: <1% and

Zn: remainder.

5. The alloy according to claim 4, wherein the composition (wt %) is as follows:

Cu: 62–65%

Bi: 0.5–1.5%

Mn: 0.3–0.5%

Si: 0.5–0.7%
Al: 0.3–0.7%
Sb: 0.05–0.1%
B: 5–15 ppm
Pb: 0–0.3%
Sn: 0–0.25%
Fe: 0–0.20%
Ni: 0–0.5% and
Zn: remainder.

6. The alloy according to claim 5 wherein the composition (wt %) is as follows:

CU: 63.0%
Bi: 0.8%
Mn: 0.45%
Si: 0.5%
Al: 0.5%
Sb: 0.1%
B: 10 ppm
Pb: <0.1%
Sn: <0.1%
Fe: <0.1%
Ni: <0.1% and
Zn: remainder.

7. The alloy according to claim 5, wherein the composition (wt %) is as follows:

Cu: 64.83%
Bi: 0.53%
Fe: 0.049%
Mn: 0.40%
B: 15 ppm
Ni: <0.01%
Si: 0.53%
Sn: <0.01%
Pb: <0.01%
Al: 0.53% and
Zn: remainder.

8. An alloy having a composition (wt %) as follows:

Cu: 64.81%
Bi: 0.33%
Mn: 0.44%
Fe: 0.039%
B: 15 ppm
Ni: <0.01%
Si: 0.53%
Sn: <0.01%
Pb: <0.01%
Al: 0.53% and
Zn: remainder.

9. A process for manufacturing components for drinking water installations, comprising:

a. providing an alloy having a composition (wt %) as follows:
Cu: 57–65%
Bi: 0.3–1.5%
Al: 0.3–0.8%
B: 5–15 ppm
impurities 0–1% and
Zn as remainder; and b. manufacturing a component for drinking water installations from the alloy.

* * * * *